United States Patent [19]

Gerch et al.

[11] Patent Number: 4,830,154

[45] Date of Patent: May 16, 1989

[54] DUFFLE TYPE SPORTS BAG

[75] Inventors: Edward L. Gerch, Chicago; Warner D. Rosenfeld, Glencoe, both of Ill.

[73] Assignee: Kingport International Corporation, Evanston, Ill.

[21] Appl. No.: 158,901

[22] Filed: Feb. 22, 1988

Related U.S. Application Data

[63] Continuation-in-part of Ser. No. 656,255, Oct. 1, 1984, Pat. No. 4,805,749.

[51] Int. Cl.[4] ..... A45C 7/00

[52] U.S. Cl. ..... 190/103; 190/107; 190/109; 190/111

[58] Field of Search ..... 190/103, 107, 108, 110, 190/115, 116, 117, 109, 111; 224/908, 910, 913

[56] References Cited

U.S. PATENT DOCUMENTS

| | | | |
|---|---|---|---|
| D. 285,748 | 9/1986 | Feinberg et al. | 190/103 |
| 2,394,332 | 2/1946 | Salem | 150/34 |
| 2,577,670 | 12/1951 | Adams | 190/48 |
| 2,597,194 | 5/1952 | Sholl | 190/41 |
| 2,662,619 | 12/1953 | Zweigbaum | 190/115 |
| 3,122,225 | 2/1964 | Ward | 190/52 |
| 3,410,376 | 11/1968 | Benzel | 190/44 |
| 3,955,609 | 5/1976 | Siegel | 150/35 |
| 4,153,093 | 5/1979 | Mahabir | 150/35 |
| 4,171,011 | 10/1979 | Kopin | 150/34 |
| 4,210,186 | 7/1980 | Belenson | 150/52 J |
| 4,236,615 | 12/1980 | Ginat | 190/52 |
| 4,301,898 | 11/1981 | Plough et al. | 190/52 |
| 4,334,601 | 6/1982 | Davis | 190/44 |
| 4,436,189 | 3/1984 | Baum | 190/108 |
| 4,489,815 | 12/1984 | Martinez et al. | 190/107 |

FOREIGN PATENT DOCUMENTS

| | | | |
|---|---|---|---|
| 2540783 | 3/1977 | Fed. Rep. of Germany | 190/115 |
| 2374866 | 7/1978 | France . | |
| 2173393 | 10/1986 | United Kingdom | 190/103 |

*Primary Examiner*—David T. Fidei

*Attorney, Agent, or Firm*—Hill, Van Santen, Steadman & Simpson

[57] ABSTRACT

An improved tube shape duffle-type travel or sports bag features an oblong, softsided, expansible central compartment having access through the top thereof, and smaller end compartments on each on the opposing ends of the oblong central compartment. The opposing compartments have circumferential slide fastener openings therearound and has an expansible wall constructed in connection and cooperation with one end wall of the main central compartment providing a collapsible pocket, preferably made of waterproof material, which is capable of extending into the main and end compartments and expanding therein as desired, preferably for positioning soiled or wet clothing or assessories therein. The central compartment further includes opposed tubular expansion panels positioned between the ends of the central sidewall panel and the respective end panels of that compartment. Each expansion panel is accordion or back folded into a horizontally compressed position and is retained in that position by a circumferential slide fastener. Slide fastening the fastener allows the expansion panel to be extended to full length, thus expanding the main compartment. A four-point mounting on the bag carries both side handles and a shoulder strap.

7 Claims, 4 Drawing Sheets

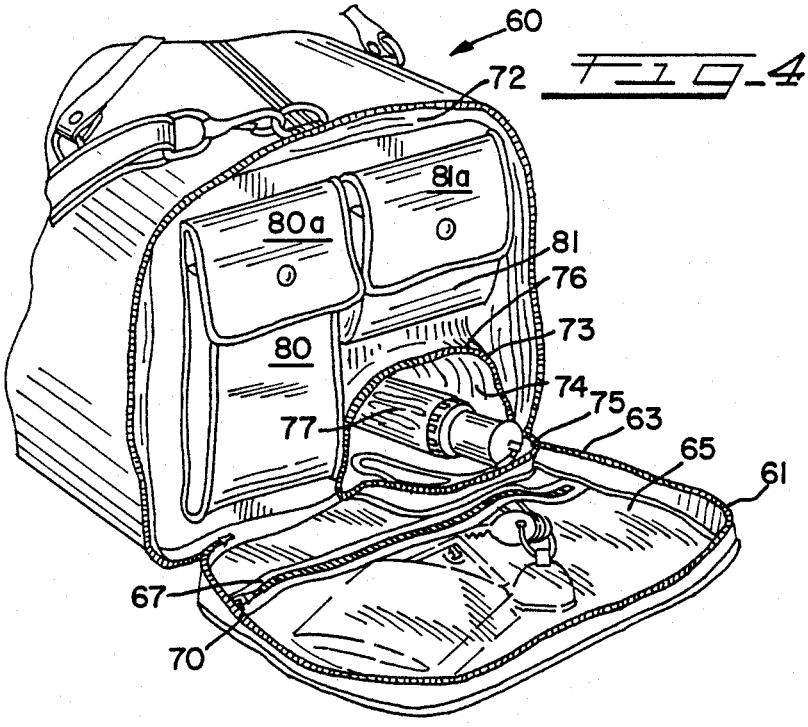
FIG. 4
FIG. 5
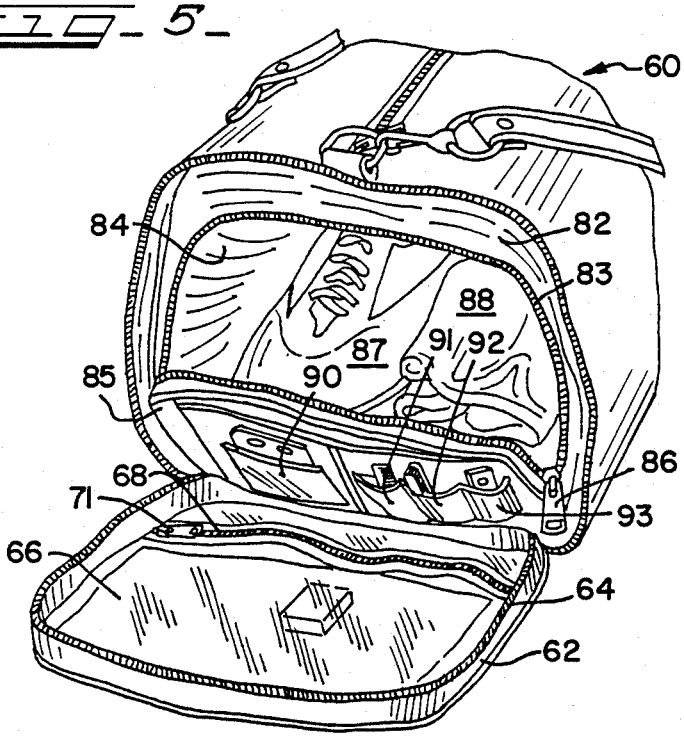

100
101
101a
101b
102
103
104
105
106
107
108
110
111
112
113
114
114a
114b
116
116a
116b
117
118
120
121
33

DUFFLE TYPE SPORTS BAG

BACKGROUND OF THE INVENTION

Related Application

This application is a continuation-in-part of the Edward L. Gerch U.S. application Ser. No. 656,255, filed Oct. 1, 1984, now U.S. Pat. No. 4,805,749.

Field of the Invention

This invention relates generally to improvements in travel or sports bags shaped like horizontally elongated duffle or roll-type bag with a large central main storage compartment having a closeable access opening and opposing smaller end compartments with end flaps giving access thereto and with one end compartment having organizer-type pockets therein and the other end compartment being substantially waterproof and expansible into the main compartment and useable for storing soiled or wet clothes. Specifically this invention deals with an expansible tubular sports bag having an elongated central top opening main compartment, and end flap opening end compartment units connected to the ends of the tube through tubular or peripheral collapsible expansion panels surrounded by slide fasteners which, when fastened together, connect the end units directly to the ends of the tube and when separated permit the expansion of the bag to increase the length of the main compartment. An inner end wall of one of the end compartment units has an opening therethrough with the mouth of a waterproof bag secured around the opening permitting the bag to expand into the main compartment or the end compartment.

Prior Art

Duffle or roll-type bags are presently enjoying popularity because of their sporting nature and their natural soft-sided features, which also find popularity in everyday travelwear as well as in sporting luggage. As in known arch-shaped sporting bags, there is a need for providing a substantially waterproof compartment in which to store already worn clothing and accessories, such as swim suits, gym shoes, and the like. However, in known arch-shape gym or sporting bags, it was known to have a substantially waterproof area positioned adjacent to the bottom of the bag along a longitudinal opening extending alongside of the bag. With respect to the roll-type bags, such a longitudinal opening is impractical as the sides of the elongated bag are generally stressed by strap-type handles. Additionally, modern sporting-type bag users are more likely to be leading a more complex life style than users of the old high school type sporting bags. It would not be uncommon for a modern sporting bag user to use the bag in connection with a trip to the handball or racquet ball court before going to the office in the morning or during a lunch break. Additionally, if the sporting-type bag is to be used in connection with a business trip, or the like, there is a need for additional organizer-type storage compartments in the bag. Therefore, a need has developed for an improved duffle or roll-type sports bag.

Heretofore known duffle or roll-type sports bags having additional compartments at the opposing ends thereof are disclosed in U.S. Pat. No. 4,334,601 and French Pat. No. 2,374,866. Bags or cases having expansible compartments exposed to an exterior end surface thereof are found at U.S. Pat. Nos. 4,171,011 and 4,236,615.

Heretofore known four point shoulder strap mountings, which adjust for right handed and left handed use, have been mounted adjacent the outside top corners of bags, which are not structurally the strongest parts of such bags. Further, these mountings were separate from side handle mountings.

SUMMARY OF THE INVENTION

The invention is directed to a tube-like travel or sports bag of the type made of pliable material and including a main storage compartment having two like-shape opposed compartment end panels and a first generally rectangular sidewall being rolled for connection at its opposed ends to the periphery of respective ones of those end panels. The entire combination defines at least a portion of the boundaries of a main storage compartment in the sports bag. An opening in a first sidewall of the main storage compartment provides access to that compartment, and the opening is provided with a closure means. The bag includes means mounted on the main compartment sidewall for user carrying of same. A second rolled sidewall extends laterally from a joinder between the first sidewall and one of the first compartment end panels, and the third like-shape end panel is connected to a peripheral end of the second sidewall forming a second compartment on the bag. An opening in the second sidewall provides access to the second compartment and second closure means are mounted adjacent to that opening. An improvement is found in the bag wherein one first compartment end panel which is positioned between the first and second compartment includes an opening therein and has a first expansible bag of flexible material secured along its opening edge to the periphery of that opening on the one panel to define a first expansible compartment which is adapted to expand at least one of the sizes of the first and second compartments on the bag. A further improvement is found in selectively expanding and contracting the length of the tube.

It is therefore an object of the present invention, generally stated, to provide a tube-like sports bag having improved storage capacity, and especially improved storage for the separation of fresh clothing from worn clothing.

A further object of this invention is to improve and simplify handles and shoulder strap mountings for tubular sports bags.

A still further object of this invention is to provide a horizontal elongated tubular sports bag with expansion panels on its ends and end compartment units on these panels arranged to be detachably directly mounted on the ends of the tubular bag to collapse the panels.

BRIEF DESCRIPTION OF THE DRAWINGS

The features of the present invention, which are believed to be novel, are set forth with particularity in the appended claims. The invention may best be understood from the following detailed description of currently preferred embodiments thereof, taken in conjunction with the accompanying drawings wherein:

FIG. 4 is a detail perspective view of an end compartment of a second embodiment of the present invention wherein that compartment includes a smaller expansible bag compartment suitable for holding an umbrella therein, and has organizer pockets positioned therein;

FIG. 5 is a detail perspective view of the opposing end of the second embodiment shown in FIG. 4 wherein the large expansible waterproof compartment includes a slide fastener over the opening thereof;

DETAILED DESCRIPTION OF THE PREFERRED EMBODIMENTS

Figure 1:
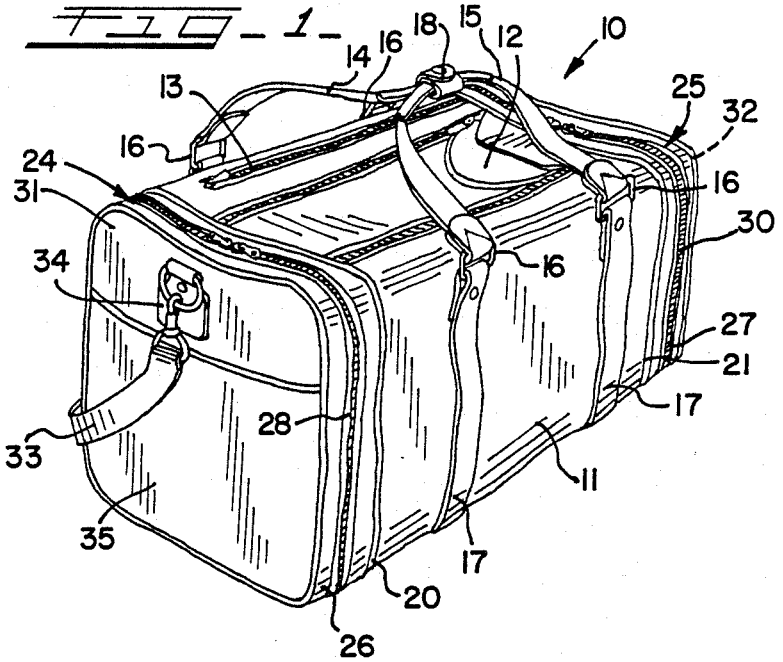
FIG. 1 is a perspective view of a sports bag, constructed in accordance with the present invention, shown in a closed condition.

Referring to FIG. 1, there is shown a first preferred embodiment of a duffle or roll-type bag 10, constructed in accordance with the present invention. In this embodiment, the bag 10 has a horizontal pliable tube providing a central elongate top opening main compartment with end flap opening end compartment units on the ends thereof separated by common end walls one of which has an opening with the mouth of a bag secured therearound. The bag can be pushed into the main compartment or the end compartment to expand either of them. It and the end compartment are preferably waterproof and both end compartments can have sub-compartments or organizer pockets therein and on the outsides of their flaps.

The bag 10 includes a generally rectangular sidewall 11 formed or rolled into a tubular shape and which may include a soft rolled bottom, or a stiff, reinforced generally flat bottom wall as desired. In this embodiment, the sidewall 11 is rolled into a somewhat square tube having rounded corners with the top portion of the sidewall including a dual slide fastener cover panel 12. Additionally, the top of the rolled side panel includes a slide fastener 13 defining the upper boundary of a generally vertical side pocket in the bag which runs substantially the entire length of the main compartment defined by the side panel 11. This embodiment of the present invention includes a dual saddle strap handle including a pair of U-shaped straps 14, 15 which are anchored inwardly adjacent the four corners of the top of bag 10 by metal rings 16—16. The rings 16—16 are attached, in turn, to strengthening straps 17—17 which are anchored to the side of bag sidewall 11. Straps 14–15 are joined at the central or bight portion by a selectively releasable loop 18.

In the embodiment sown in FIG. 1, circumferential piping 20–21 defines the end boundaries of a main compartment formed by rolled sidewall 11. The actual opposing end walls 22, 23 of the main compartment are show in FIGS. 2 and 3, respectively, and will be discussed in greater detail below. Outwardly adjacent the opposed end walls 22, 23 are positioned two opposing smaller compartments 24, 25 which each include a rolled bifurcated sidewall 26, 27, respectively, having a circumferential slide fastener 28, 30 positioned thereon and substantially therearound providing a selectable closeable opening for each of the opposing compartment. Compartments 24 and 25 include opposing end walls or flaps 31, 32 (the latter being shown in outline only) which define the outer end boundaries of bag 10. These flaps are hinged to the bottoms of the end compartments and the fasteners 28, 30 secure them around their remounting periphery into closed position. A shoulder strap 33 is releasably attachable to the opposing end walls 31, 32 by matching hook and ring fasteners 34—34 (only one shown) to provide for ease of user carrying. In an additional feature of the present invention, each end wall includes an open top pocket such as shown at 35 which is connected along the remainder of its periphery the periphery of end wall 31, thus providing a place to removably position articles as the user desires.

Figure 2:
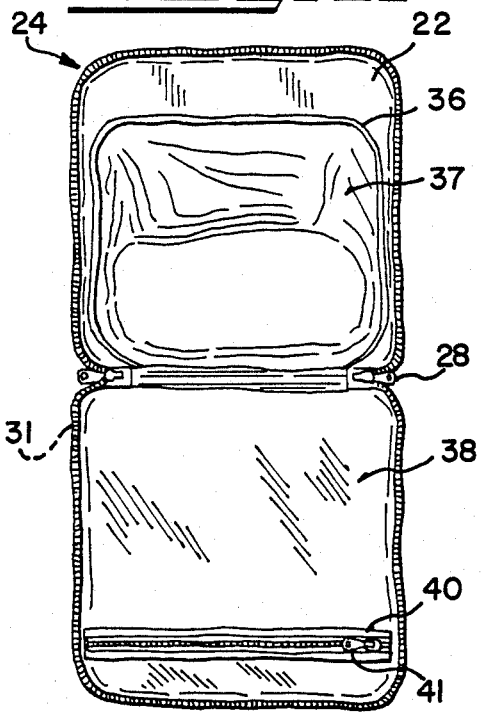
FIG. 2 is an end elevational view of the sports bag with the end compartment opened showing the expansible dividing wall-pocket therein.
Figure 3:
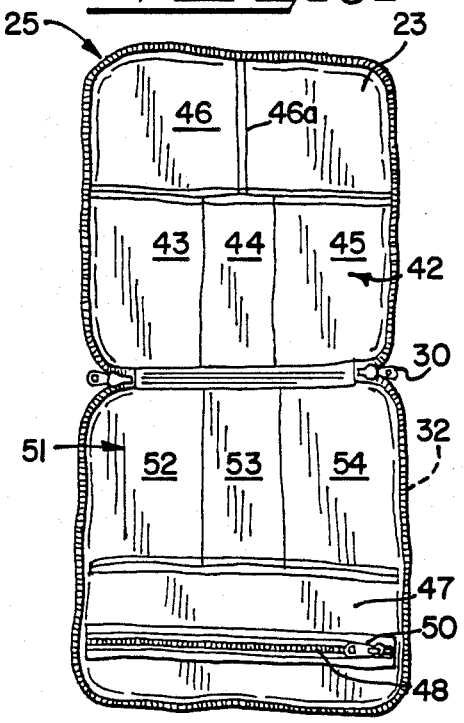
FIG. 3 is an end elevational view of the opposing smaller compartment on the sports bag of the present invention shown in an open position disclosing a plurality of pockets in an organizer-compartment.

Referring to FIGS. 2 and 3, an important feature of the present invention resides in the utilization of the interior of opposed side compartments 24, 25 to provide a combination of business-organizer and work clothing storage capability to the bag. As shown most clearly in FIG. 2, when compartment 24 is opened by means of dual slide fastener 28, the end wall 22 of the main compartment may be seen in full view most clearly. In this embodiment, the vertical end wall 22 has a substantial aperture, the outline of which is shown at 36 in FIG. 2, having an area which is greater than approximately one-half of the size of end panel 22. Outline 36 of the aperture forms a joint with a generally waterproof fabric expandable pocket 37 which preferably extends in the main compartment of bag 10 so as to expand the size of compartment 24 as desired. Waterproof pocket 37 may be utilized for placing worn athletic or other clothing, shoes, etc. back into the bag after use while separating them from the remainder of the clothing in the main compartment of bag 10. Additionally, the end wall 31 of compartment 34 has a like-shaped waterproof panel 38 positioned on the inside thereof to define an additional pocket to which access is obtained through opening 40 having a slide fastener 41 affixed thereto. Materials positioned in the pocket defined by end wall 31 and inner waterproof panel 38 are thereby separated from the interior of pocket 37 by the waterproof panel.

Referring to FIG. 3 the opposing compartment 25 in bag 10 is shaped exteriorly identical to the exterior of compartment 24. However, the interior of compartment 25 as shown most clearly in FIG. 3, includes a plurality of pockets forming an organizer compartment for the bag user. End wall 23 includes a panel 42 which is affixed to the bottom and a portion of the opposing sides of end panel 23 to define three pockets, 43, 44 and 45, respectively, therein with access from the open top of each. An additional pocket is formed by the affixation of panel 46 along a portion of the top and one side of the periphery of the end panel 23 leaving a vertical opening 42A to provide access to the pocket. Similarly to end wall 31, end wall 32 includes a waterproof inner panel 47 affixed along the periphery of end wall 32, and includes slit 48 bounded by a slide fastener 50 to define a waterproof pocket in the end panel. Additionally, in a similar manner to panel 42, an additional panel 51 is affixed along the bottom end and peripheral portions of the sides of panel 47 to define three pockets therein 52, 53 and 54, respectively, each having an open top thereto. Therefore, a total of seven open pockets and one closed pocket are found in compartment 25 to provide an organizer capability to the bag 10 of the invention which increases the versatility of the bag for its owner.

In a second preferred embodiment as shown in FIGS. 4 and 5, a modification of the end compartments in a bag 60, constructed in accordance with the present invention, includes opposing hollowed shallow half-shell type access covers 61, 62, respectively, each having a slide fastener 63, 64 substantially around the perimeter thereof for fastening the half shell panel to the central compartment portion of the bag 60. The inside of each half shell end compartment portion 61, 62 includes a generally waterproof inner panel 65–66 having a slit-type opening 67, 68 which is selectably closeable by a slide fastener 70, 71, respectively, to provide an additional waterproof pocket in the end compartment of each of the opposing ends of the bag 60.

As shown most clearly in FIG. 4, the end panel 72 of the large central compartment in bag 60 has an aperture 73 therein which is smaller than aperture 36 in end panel 22 of bag 10. Aperture 73 has affixed to its boundary the mouth of a bag or hollow waterproof pocket 74 extending into the main compartment, aperture cover 75 adapted to close the aperture, and slide fastener means 76 on the cover 75 and aperture 73 for selectively closing the cover over the pocket. The pocket 74 is sized preferably for fitting a foldable umbrella 77 therein. Additionally, end wall 72 includes, in this embodiment two differing size covered pockets 80, 81, each having snap fastenable covers 80*a* and 81*a* which fit over the top openings thereof to provide sufficient closure means for retaining objects positioned therein as desired by a user.

Referring to FIG. 5, an opposing end wall 82 of the main compartment in bag 60 includes an aperture 83 sized similarly to aperture 36 on end panel 22 of bag 10. Aperture 83 has affixed along the periphery thereof the mouth of a waterproof pocket or bag 84 extending into the large central compartment of the bag 60, an end panel closure 85 permanently attached along the bottom of aperture 83, and a slide fastener 86 for closing panel 85 over aperture 83. As shown most clearly in FIG. 5, pocket 84 is of substantial size so as to allow the positioning of large clothing material such as shoes 87 and towels 88 therein with comfort. In order to provide additional storage space for small user items, pockets 90, 91, 92 and 93 are positioned on the outer surface of cover 85. Thus, a modification of the organizer of the end pockets of the present invention has been shown and described.

Referring to FIGS. 6–9, a third longitudinally expansible embodiment has collapsible expansion panels connecting the end compartments and the ends of the tube which are surrounded by slide fastener runs which when connected unite the end compartments directly to the tube ends collapsing the panels thereunder and when separated permit the panels to expand increasing the length of the bag and its storage capacity. As shown, the duffle or roll type bag 100 includes, as in the first embodiment rectangular sidewalls 101, a bottom wall 101*a* and a top wall 101*b* rolled into a somewhat square tube having rounded corners with the top portion 101*b* including a cover panel 102 which is opened and closed with dual slide fasteners 103—103. The top of the rolled side panel includes a slide fastener 104 defining the upper boundary of a generally vertical side pocket as in the first embodiment. Likewise, a dual saddle strap handle includes a pair of U-shaped straps 105–106 which are anchored to the side of the bag sidewall 101 and, in this third embodiment, include metal rings 107—107 attached by fastening straps 108—108 to the inside of each of the four edges of U-shape straps 105–106, respectively, at the juncture of those straps and the side panel to provide adjustable four-point mounting for a shoulder strap 33. Since the handles of the bag have already been engineered to adequately suspend the entire weight of the bag, no new stiffening or added support need be used.

As in the first embodiment, second and third closed end compartments 110, 111 are positioned outwardly of the ends of the main compartment of roll type bag 100. End compartment 110 includes a generally rectangular bifurcated sidewall 112 which is rolled into a tubular shape with square corners similar to sidewall 101 and has a slide fastener 113 mounted along a generally circumferential opening in the compartment and an end wall or flap 114 forming an end closure of compartment 110. However, in this third embodiment of the present invention, the outer edge of the common wall 115 between compartment 110 and the main compartment of the sports bag 100 there is positioned a circumferential separable slide fastener 116. Likewise, between end compartment 111 and the main central compartment of sports bag 100 is a similar separable circumferential slide fastener 117.

Figures 6, 7, 8:
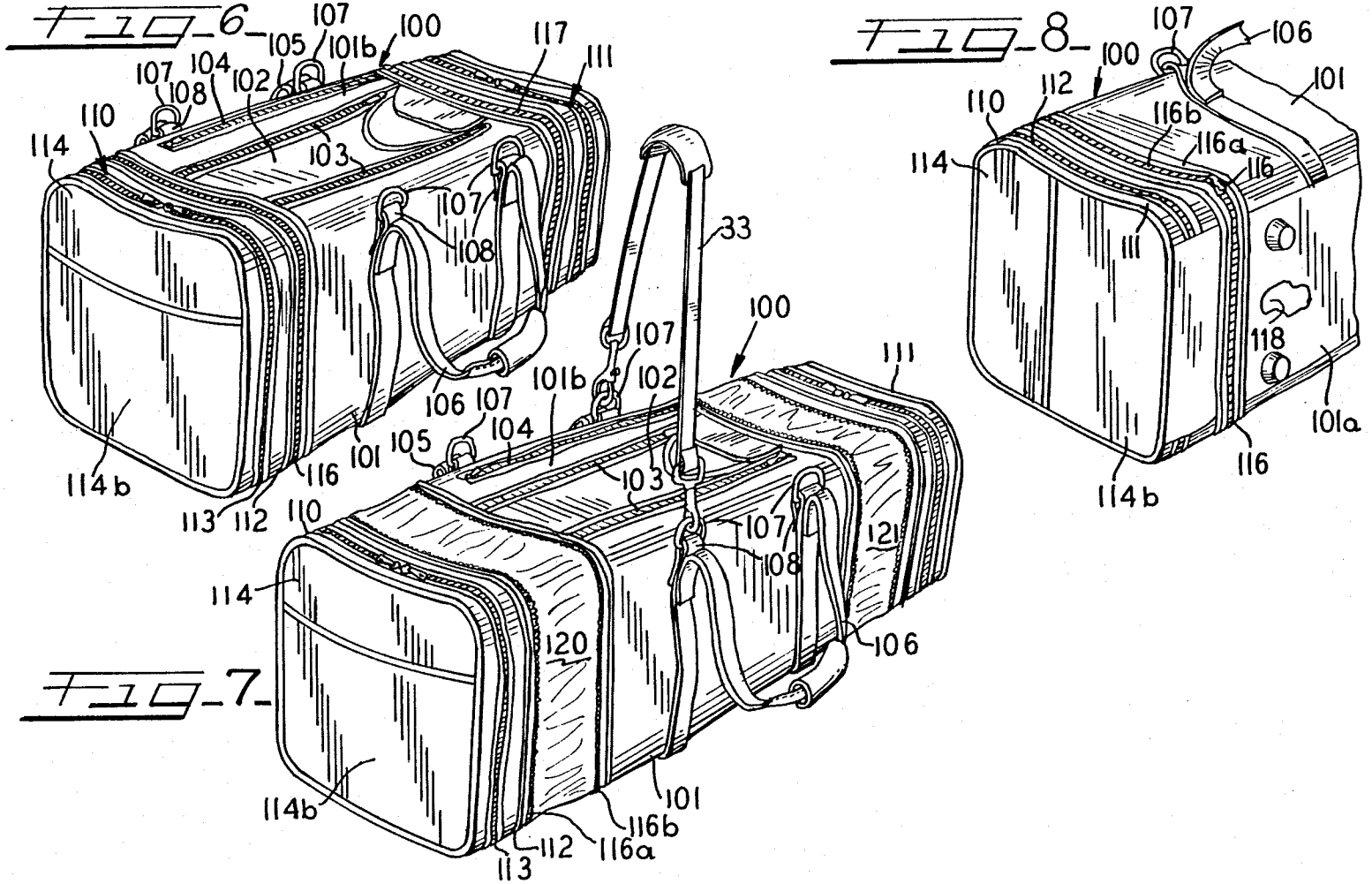
FIG. 6 is a perspective view of a third embodiment of the sports bag of the present invention shown in unexpanded condition.
FIG. 7 is a perspective view of the bag shown in FIG. 6 as it appears in an expanded condition.
FIG. 8 is a fragmentary perspective of the bag shown in FIG. 6 showing the construction of the bottom of the third embodiment.
Figure 9:
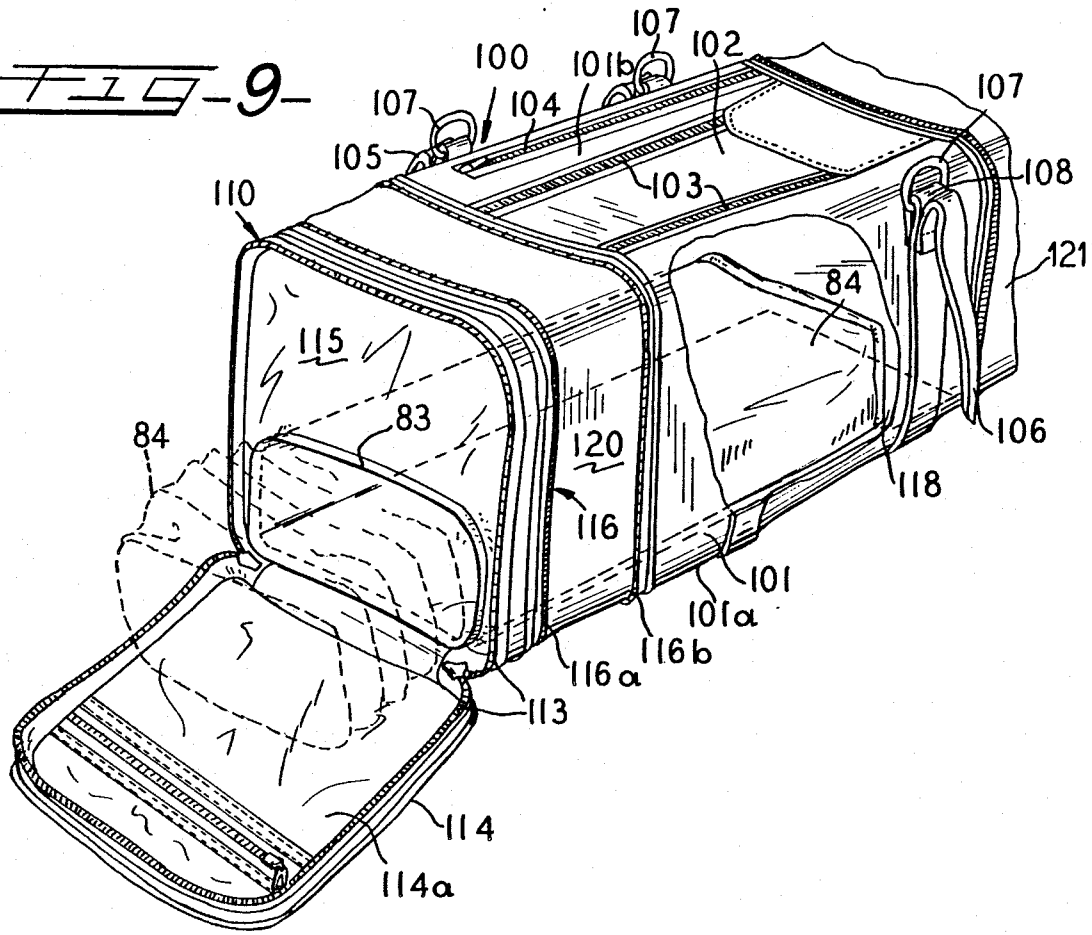
FIG. 9 is a fragmental perspective view similar to FIG. 7 but showing the front end unit in open position with the wet bag extended into the main compartment, and the tube broken away to show the interior of the main compartment.

Referring to FIGS. 7 and 9, when slide fasteners 116 and 117 are in opened condition, opposed expansible panels 120–121 are allowed to expand to lengthen the tubular bag and to expand the central compartment of the third embodiment of the present invention. These tubular expansion panels 120–121 are made of pliable foldable material such as nylon, and extend 360 degrees around the circumference of the sports bag 100 to substantially increase the interior volume of the main compartment therein. Of course, if desired, expansible panels 120 or 121 may be positioned on the opposite or outside of the common wall 115 between the central main compartment and the opposing outer compartments 110–111 so any two of the three compartments in the sports bag may be expansible.

Referring to FIG. 8, the slide fastener 116 is shown as it extends across the side panel 101 to close the fastener runs. Slide fastener 116 includes web halves 116*a*–116*b* which are joined by the slide fastener 116 and have separable ends at one side of the bag to expose the underlying expansion panel 120 for expansion. The web halves are affixed along their bases to the respective joinders between the expansible sidewall 120, the main sidewall 101, and the end wall 115 of the third embodiment of the present invention. The combination of the expansible bag 84 extending into the central compartment from at least one of the opposing end compartments or into the end compartment, and the expansible tubular sidewalls or panels 120, 121, provide the sports duffle bag of the invention with versatility and adjustability heretofore unknown in sports bags.

As shown in FIG. 9, when the expansion panel 120 is opened up, the bag 84 on the apertured end wall 115 is pulled therewith over the bottom 101*a* of the main compartment and is free to slide thereover or over a stiff panel 118 on this bottom 101*a*. The bag 84 has a free closed end and can be stretched to its full length in the main compartment or stuffed into the end compartment thus further extending the main compartment or extending he end compartment into the main compartment.

The compartments of the end units in the third embodiment are also equipped with sub-compartments and as shown in FIG. 9 the flap 114 has a slide fastener closed pocket 114*a* on its inner face which, with the inner wall 115 and wet bag 84, are waterproof. As shown in FIGS. 6–8, the outer face of the flap 114 has a top opening pocket 114*b*. Organize compartments can also be provided in one or both end units.

While three particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

We claim as our invention:

1. In a tube-like sports bag of the type made of pliable material and including a main storage compartment having first and second-like shape opposed compartment end panels and a first generally rectangular sidewall being rolled for connection at its opposed ends to the periphery of respective ones of said end panels for defining at least a portion of the boundaries of said main storage compartment therein, an opening in said first sidewall for providing access to said main compartment and first closure means mounted adjacent said opening, means mounted on said sidewall for user carrying of said bag, a second rolled sidewall extending laterally from a said first sidewall and said first compartment end panel and a third like-shaped end panel connected to a peripheral end of said second sidewall forming a second compartment on said bag, an opening in said second sidewall for providing access to said second compartment and second closure means mounted adjacent said opening, the improvements which comprise said first compartment end panel positioned between said first and said second compartments having an opening therein and a first expansible bag of flexible material secured along its opening edge to the periphery of said opening on said one end panel defining a first expansible compartment adapted to expand the size of at least one of said first and said second compartments on said bag, a generally rectangular flexible sidewall expansion member rolled for connection between the periphery of said first generally rectangular sidewall and sail second rolled sidewall for providing expansibility to one of said main compartment and said second compartment, and closure means positioned outwardly of said sidewall expansion member and having one portion thereof secured to the periphery of said first compartment end panel and having a second portion thereof secured to the periphery of said first generally rectangular side panel and said second rolled sidewall, said first and second portions thereof being releasably engagable for providing selective usability of said expansion member.

2. An expansible tubular sports bag which comprises an elongated horizontal tube of pliable material having opposite ends, a longitudinal opening in the top thereof giving access to the interior thereof, means closing said opening, a pair of end compartment units each secured to and extending from an opposed slide fastener tapes dividing the peripheral wall around most of its periphery to give access to the compartment between the inner wall and flap while hinge connecting the flap to the wall, a first slide connecting said first slide fastener tapes to secure the tapes together for closing the end compartments, a pliable peripheral expansion panel connecting the periphery of each end of the tube with an end compartment unit around the periphery of the inner end wall of the unit, second slide fastener tapes surrounding and dividing the expansion panel and respectively secured around an end of the tube and around the inner wall of the adjacent end compartment unit, and a second slide selectively connecting and separating the second separable fastener tapes to collapse the underlying expansion panel and connecting end units directly to the tube and to detach the end unit from the tube and uncover the expansion panel to expand the length of the interior of the tube.

3. A longitudinally expansible horizontal tubular bag having a central main compartment with a closurable longitudinal opening giving access thereto and separate end compartment units joined to the ends of the tubular bag by expansible and collapsible peripheral panels, slide fastener tapes on the inner ends of the end compartment units and outer ends of the tubular bag surrounding the expansion panels, fastener slides selectively connecting the tapes to secure the end units directly to the ends of the tube and to disconnect the tapes to expose the expansion panels and permit the end units to be pulled away from the ends of the tube increasing the length of the bag and the capacity of the main compartment of the bag, each of said end compartment units having inner end walls closing the ends of the main compartment and outer end flaps to expose the end compartments, and the inner end wall of at least one of said end compartment unite having an aperture therethrough, a wet bag having its mouth secured around the perimeter of the aperture, said bag being selectively expansible into the main compartment or into the end compartment to increase the capacities thereof, each of said end compartments having sub-compartments therein mounted on the outer face of their inner walls and the inner face of their flaps, and common handle and strap mountings in spaced longitudinal relation on both sides tube adapted to carry both U-shaped side handles and the ends of a shoulder strap.

4. The sports bag of claim 2 wherein the inner end wall of an end compartment unit has an aperture therethrough, a wet bag having a mouth secured around the perimeter of the aperture said wet bag having a free end opposite its mouth which is adapted to be stuffed into the main compartment or the end compartment to selectively increase the size of the interior of the tubular bag or the end compartment, and wherein said wet bag is moveable with said inner end wall as the expansion panel is collapsed and expanded.

5. The sports bag of claim 2 wherein the end compartments have sub-compartments therein for receiving personal articles.

6. The sports bag of claim 2 wherein the flaps of the end compartments have free tops and sides and are permanently attached to the units only at the bottoms thereof.

7. The sports bag of claim 2 including a stiff removeable panel on the bottom of the tube forming a rigid base for the main compartment.

* * * * *